US012239195B2

(12) United States Patent
Habibi

(10) Patent No.: US 12,239,195 B2
(45) Date of Patent: Mar. 4, 2025

(54) AUTOMATIC CURLING MECHANISM

(71) Applicant: Masood Habibi, Santa Monica, CA (US)

(72) Inventor: Masood Habibi, Santa Monica, CA (US)

( * ) Notice: Subject to any disclaimer, the term of this patent is extended or adjusted under 35 U.S.C. 154(b) by 769 days.

(21) Appl. No.: 16/739,045

(22) Filed: Jan. 9, 2020

(65) Prior Publication Data

US 2020/0138160 A1 May 7, 2020

Related U.S. Application Data

(63) Continuation of application No. PCT/US2018/041339, filed on Jul. 9, 2018.

(60) Provisional application No. 62/530,243, filed on Jul. 9, 2017.

(51) Int. Cl.
*A45D 1/08* (2006.01)
*A45D 1/04* (2006.01)

(52) U.S. Cl.
CPC ..... *A45D 1/08* (2013.01); *A45D 1/04* (2013.01)

(58) Field of Classification Search
CPC ... A45D 1/06; A45D 1/08; A45D 1/04; A45D 1/14; A45D 1/16; A45D 1/10; A45D 1/18; A45D 2/04; A45D 2/06; A45D 2/16; A45D 2/26; A45D 2/28; A45D 2/30; A45D 2/32; A45D 2/367; A45D 2/2457; A45D 6/04
See application file for complete search history.

(56) References Cited

U.S. PATENT DOCUMENTS 3,712,310 A * 1/1973 Parlagreco ..... A45D 2/2457 132/252
8,232,505 B2 * 7/2012 Hottenrott ..... A45D 1/06 219/225
8,237,089 B2 * 8/2012 Legrain ..... A45D 1/08 219/225
9,185,957 B2 * 11/2015 Richmond ..... A45D 1/04
(Continued)

FOREIGN PATENT DOCUMENTS

CN 205492908 * 8/2016
EP 1991083 8/2013
(Continued)

OTHER PUBLICATIONS

CN 205492908 translation; Xiao et al., Aug. 2016.*
WO, PCT/US2018/041339 ISR and Written Opinion, Oct. 5, 2017.

*Primary Examiner* — Rachel R Steitz
(74) *Attorney, Agent, or Firm* — ONE LLP; Jonathan Jaech

(57) ABSTRACT

An automatic curling iron includes at least two parallel prongs defining a gap aligned along a longitudinal axis. A rotation mechanism drives at least one of the prongs around the longitudinal axis. A thermally insulated handle holds the revolving mechanism with the two prongs extending. An electrical circuit housed in the housing powers the revolving mechanism heats at least one of the prongs. Optionally, the apparatus includes a stationary outer styling shell coupled to the housing and enclosing at least a portion of the prongs. The outer styling shell can be separated into sections so enable access to the gap and may be expandable. One or more fins of elastomeric high temperature material may be mounted to an interior of the styling shell and positioned to hold strands of hair against a heated one of the prongs.

20 Claims, 8 Drawing Sheets

(56) References Cited

U.S. PATENT DOCUMENTS

| | | | | |
|---|---|---|---|---|
| 10,897,973 | B2 * | 1/2021 | Lee | A45D 1/04 |
| 2009/0032048 | A1 * | 2/2009 | Suzuki | A45D 1/06<br>132/224 |
| 2011/0180096 | A1 | 7/2011 | Palermo et al. | |
| 2011/0203606 | A1 * | 8/2011 | Recchion | A45D 1/04<br>132/269 |
| 2012/0111357 | A1 * | 5/2012 | Amkie | A45D 1/04<br>132/230 |

FOREIGN PATENT DOCUMENTS

| | | |
|---|---|---|
| WO | WO 1997/042848 | 11/1997 |
| WO | WO 2014/173554 | 10/2014 |

* cited by examiner

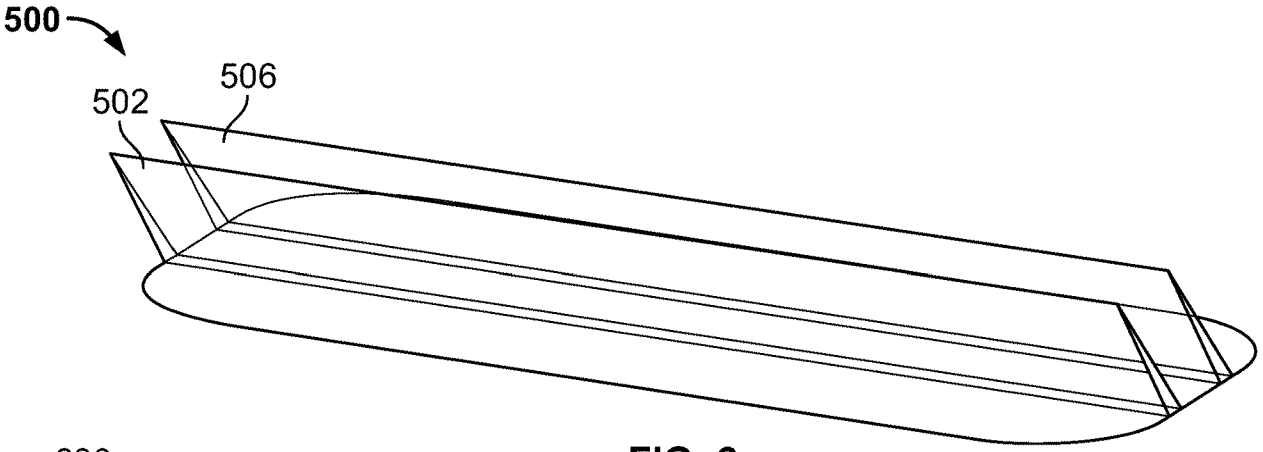
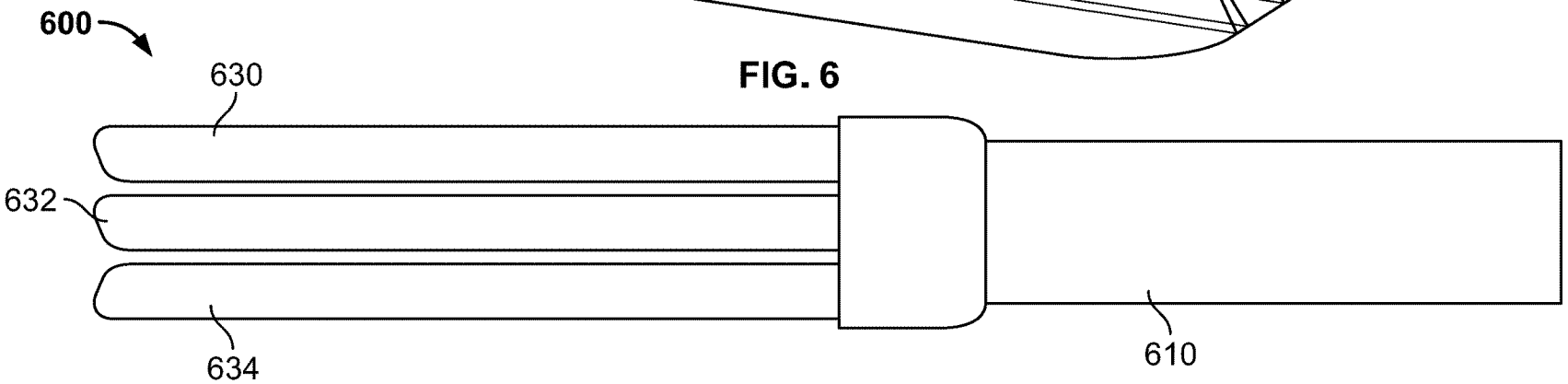
FIG. 6
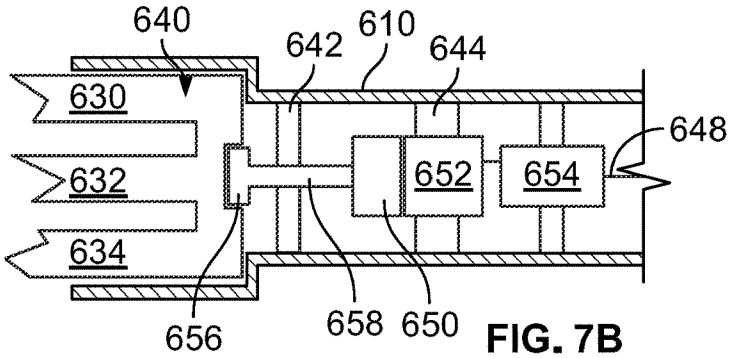
FIG. 7A
FIG. 7B

AUTOMATIC CURLING MECHANISM

PRIORITY CLAIM

The present application is a continuation of International (PCT) Application No. PCT/US2018/041339 filed Jul. 9, 2018, which claims priority to U.S. Provisional Patent Application Ser. No. 62/530,243 filed Jul. 9, 2017, the disclosures of both of which are incorporated herein in their entireties by reference.

FIELD

The present application relates to apparatus and methods for curling or similarly styling human hair using heated personal care equipment.

BACKGROUND

Various types of equipment for curling hair by hand using application of heat, known as curling irons or curling wands, are known in the art. Curling irons and wands typically have a form factor that includes a thermally conductive, electrically heated curling rod (the "barrel") attached to a thermally insulated handle. The barrels are often made of metal or ceramic material and come in various form factors and sizes. The barrel is typically heated to a temperature in a range of about 250° F. to 450° F. Once the barrel is hot, the user wraps the hair to be curled tightly around the barrel and holds the hair in place against the hot barrel until the curl is set.

Motorized curling equipment exists, but current designs are subject to certain deficiencies. Existing designs wrap the hair circularly around the barrel, so that the later-wrapped hair sits on top of earlier-wrapped curls. This causes the later-wrapped hair to be insulated from the heat of the iron, resulting in a poor set. Nonetheless, existing motorized designs lack the ability to conveniently wrap hair around a hot barrel so that all layers of the wrap receive a good set.

It would be desirable, therefore, to develop new apparatus and methods for curling human hair, that overcomes these and other limitations of the prior art.

SUMMARY

This summary and the following detailed description should be interpreted as complementary parts of an integrated disclosure, which parts may include redundant subject matter and/or supplemental subject matter. An omission in either section does not indicate priority or relative importance of any element described in the integrated application. Differences between the sections may include supplemental disclosures of alternative embodiments, additional details, or alternative descriptions of identical embodiments using different terminology, as should be apparent from the respective disclosures.

In an aspect of the disclosure, an apparatus for curling hair may include at least two parallel prongs defining a gap there between and aligned along a longitudinal axis. At least one of the prongs is thermally conductive; for example, may have a thermally conductive exterior surface capable of being heated within a range of about 250° F. to about 450° F. for styling hair.

The apparatus may further include a rotation mechanism coupled to at least one of the prongs at a base of each prong, configured to rotate at least one of the prongs around the longitudinal axis. The prongs may be fixed relative to one another and rotate together around the longitudinal axis. In an alternative, one prong may be stationary, and the rotation mechanism may rotate another prong around the stationary prong.

The apparatus may further include a thermally insulated housing comprising a handle portion, holding the rotation mechanism with the two prongs extending away from the handle portion. It may further include an electrical circuit for powering the rotation mechanism and for heating the at least one of the prongs, housed in the housing. The rotation mechanism may be, or may include, an electric motor coupled to a gearbox. The electrical circuit may include or be connected to a user interface control for adjusting a direction of rotation of the rotation mechanism.

The apparatus may include a stationary outer styling shell coupled to the housing and enclosing at least a portion of the prongs. The outer styling shell may include at least two longitudinal sections of a cylinder separated so as to expose a length of the gap from an open end of the prongs to near the base. The electrical circuit may be configured to return the rotation mechanism to a "home" state in which the gap between the prongs is aligned with a longitudinal opening between the at least two separated sections of the outer styling shell. The at least two longitudinal sections may be coupled to an expansion mechanism that enables a user to expand and contract a perimeter of the outer styling shell.

In some embodiments, the outer styling shell is thermally conductive and coupled to a heater of the electrical circuit. In other embodiments, the outer styling shell has a thermal conductivity less than about 10 W/m K. In these and other embodiments, an exterior of the outer styling shell may include a least one of ridges or teeth for engaging hair to be styled.

In an aspect, the apparatus may include at least one fin of elastomeric high temperature material mounted to an interior of the styling shell and positioned to hold strands of hair against a heated one of the prongs. In an aspect, the at least one fin includes multiple parallel fins. The elastomeric material may be, or may include, a silicone rubber material with a hardness in a range of 10 to 90 Shore A.

The prongs of the apparatus may be variously configured. In some embodiments, the prongs are substantially identical and arranged symmetrically around the longitudinal axis. In other embodiments, the at least one of the prongs that is thermally conductive is stationary and connected to the electrical circuit for heating. In some embodiments, a movable one of the prongs has a smaller average cross-section than the stationary one of the prongs. In some embodiments, the rotation mechanism is configured for rotating the movable one of the prongs around the stationary one of the prongs. In other embodiments, the rotation mechanism is configured for rotating both prongs together around the longitudinal axis. The apparatus may include an adjustment mechanism for adjusting separation between the prongs.

The apparatus may further include a pusher mechanism and guide for guiding strands of hair along a length of the prongs as operation of the rotation mechanism causes hair to wrap around the at least two prongs. The pusher mechanism and guide help the hair wrap in a helix along the length of the heated prong(s), so the hair does not wrap over itself and thereby impede heating of the hair to be styled.

A method of using an automatic curling iron to style hair may include inserting a bundle of hair between parallel prongs of an automatic curling iron. The method may further include heating at least one of the prongs to a desired operating temperature. The method may further include rotating by an electrical motor at least one of the prongs around a common longitudinal axis of the prongs while moving a protruding end of the bundle of hair along the longitudinal axis, causing the bundle of hair to wrap in a helix around at least one of the prongs. The method may further include releasing the bundle of hair once heated.

To the accomplishment of the foregoing and related ends, one or more examples comprise the features hereinafter fully described and particularly pointed out in the claims. The following description and the annexed drawings set forth in detail certain illustrative aspects and are indicative of but a few of the various ways in which the principles of the examples may be employed. Other advantages and novel features will become apparent from the following detailed description when considered in conjunction with the drawings and the disclosed examples, which encompass all such aspects and their equivalents.

BRIEF DESCRIPTION OF THE DRAWINGS

The features, nature, and advantages of the present disclosure will become more apparent from the detailed description set forth below when taken in conjunction with the drawings in which like reference characters identify like elements correspondingly throughout the specification and drawings.

FIG. 6 is a perspective view illustrating a multi-bladed elastomeric fin for holding hair against a rotating prong or prongs.

FIG. 7A is a side view illustrating an exterior of a three-pronged automatic curling iron; the styling shell is omitted for illustrative simplicity.

FIG. 7B is a schematic diagram showing an example of certain interior components of an automatic curling iron for rotating two or more prongs.

DETAILED DESCRIPTION

Various aspects are now described with reference to the drawings. In the following description, for purposes of explanation, numerous specific details are set forth in order to provide a thorough understanding of one or more aspects. It may be evident, however, that the various aspects may be practiced without these specific details. In other instances, well-known structures and devices are shown in block diagram form in order to facilitate describing these aspects.

Figure 1:
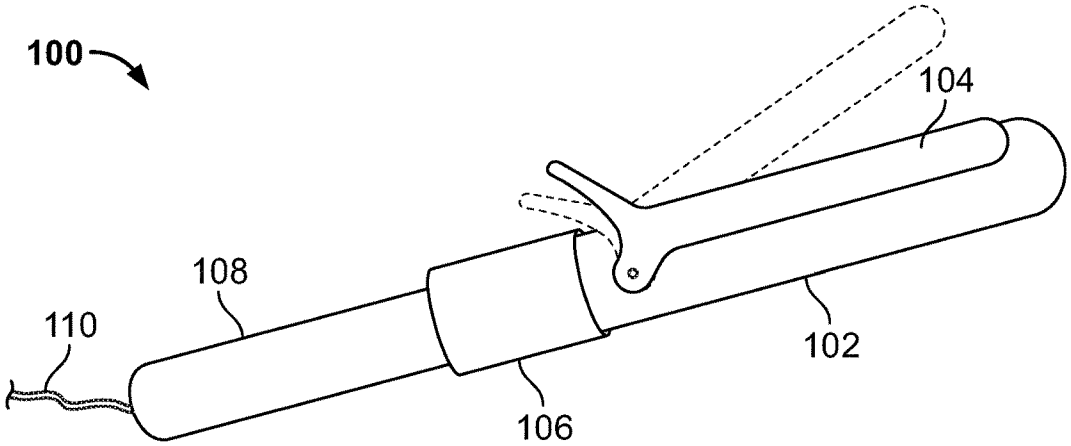
FIG. 1 (Prior Art)
FIG. 1 is an isometric drawing illustrating a prior art curling iron.

Referring to FIG. 1, a prior art curling iron 100 typically includes a heated conductive barrel 102 of metallic or ceramic material, a transition section 106 attaching the barrel 102 to a thermally insulated handle 108, and a spring-loaded pivoting tong 104 for holding hair close to the barrel during styling. Electrical components (not shown) in an interior of the curling iron 100 heat the curling iron with power supplied by an electrical cord 110. Curling wands are similar to the curling iron 100 but lack a tong or equivalent feature. Instead, the user wraps hair around the barrel of the hand while keeping the strands of hair under tension.

Figure 2:
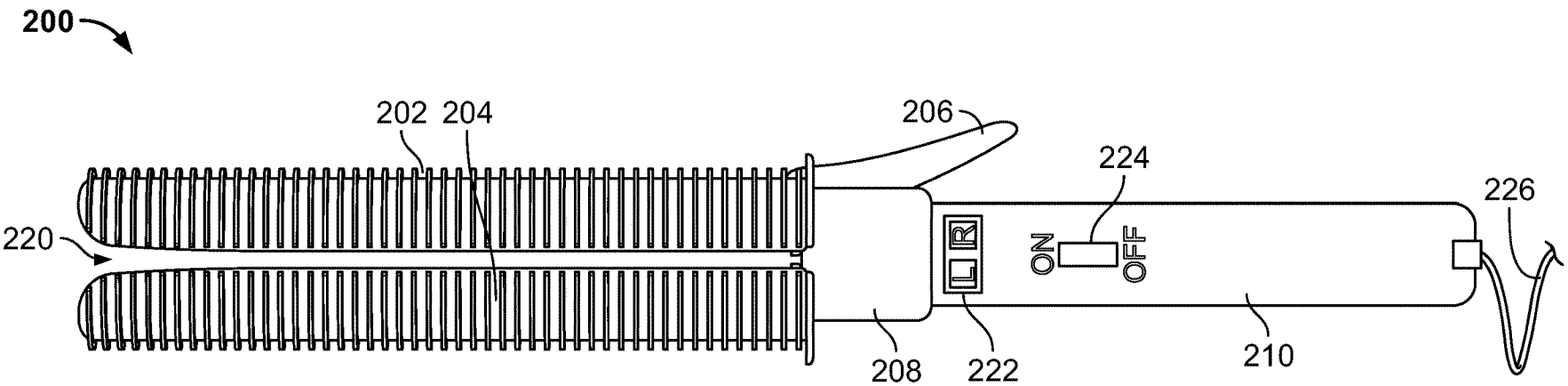
FIG. 2 is a side view illustrating an exterior of an automatic curling iron with a styling shell.
Figure 3:
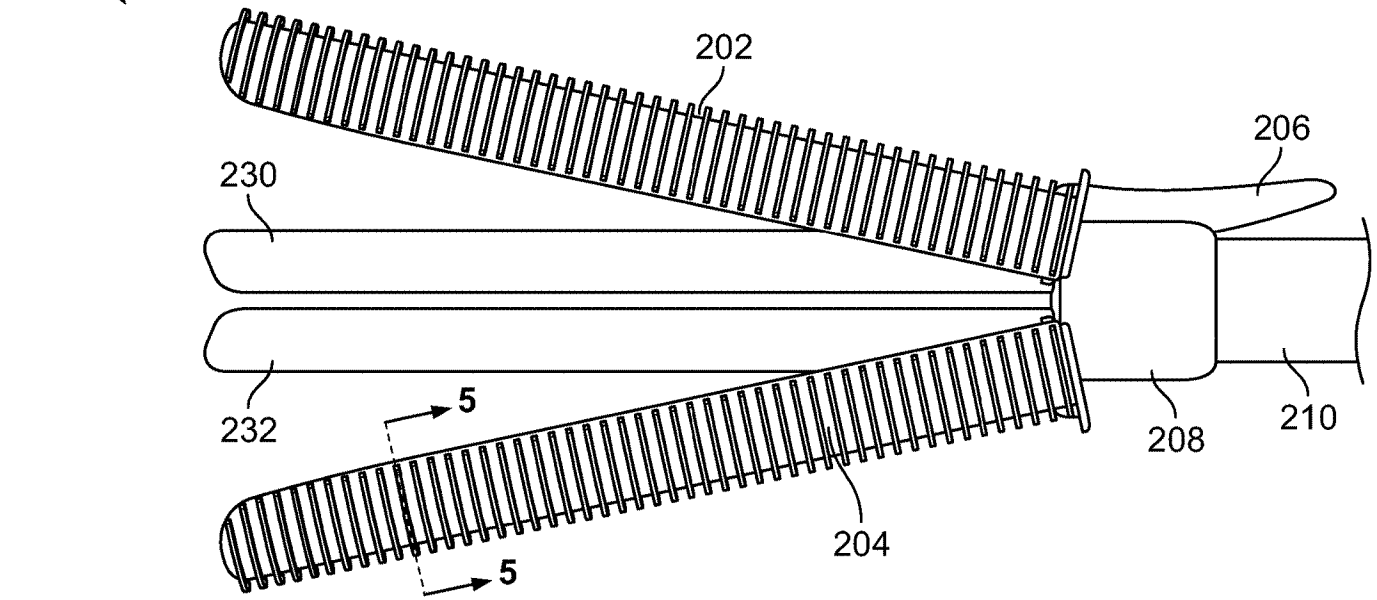
FIG. 3 is a side view illustrating the styling shell in an open position, exposing interior prongs.

Referring to FIGS. 2 and 3 an exterior of an automatic curling iron 200 with a styling shell 202, 204 is shown. In FIG. 2 the styling shell 202, 204 is shown in a closed position, concealing a set of interior heating prongs. In FIG. 3 the styling shell halves 202, 204 are shown in an open position, exposing the interior prongs 230, 232. The automatic curling iron 200 may include at least two parallel prongs 230, 232 defining a gap 220 there between and aligned along a longitudinal axis 245. At least one of the prongs 230 and/or 232 is thermally conductive; for example, may have a thermally conductive exterior surface capable of being heated within a range of about 250° F. to about 450° F. for styling hair. For example, the prongs may be made of metal or thermally-conductive ceramic and heated by an electrical resistance heater.

The prongs 230, 232 may be fixed relative to one another and rotate together around the longitudinal axis 245. In an alternative, one prong may be stationary, and the rotation mechanism may rotate another prong around the stationary prong. The prongs 230, 232, styling shell sections 20, 204 and handle 210 may be aligned parallel to the axis 245. Rotation mechanisms are discussed below in connection with FIGS. 7B, 8B and 10B.

Figure 8A:
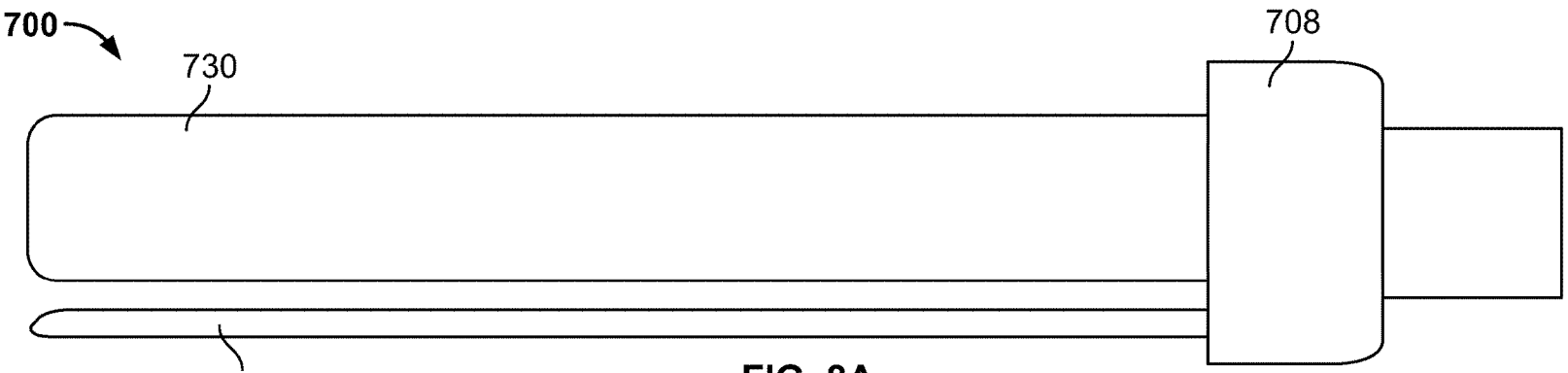
FIG. 8A is a side view illustrating an exterior of a two-pronged automatic curling iron with unequal-sized prongs; the styling shell is omitted for illustrative simplicity.
Figure 8B:
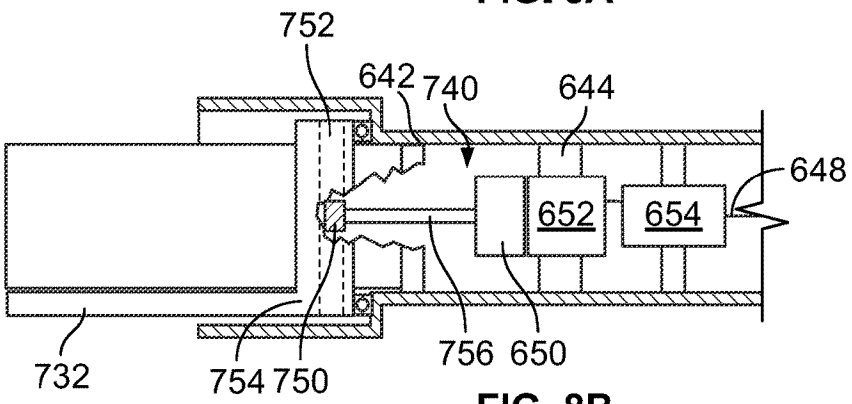
FIG. 8B is a schematic diagram showing an example of certain interior components of an automatic curling iron for rotating one prong around a stationary prong.
Figure 10A:
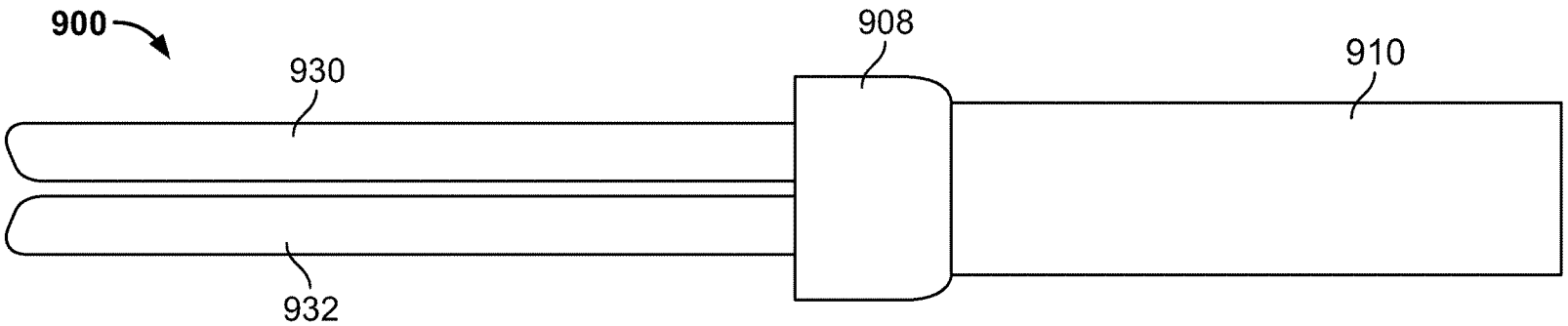
FIG. 10A is a side view illustrating an exterior of a two-pronged automatic curling iron with a mechanism for adjusting a distance between the prongs; the styling shell is omitted for illustrative simplicity.
Figure 10B:
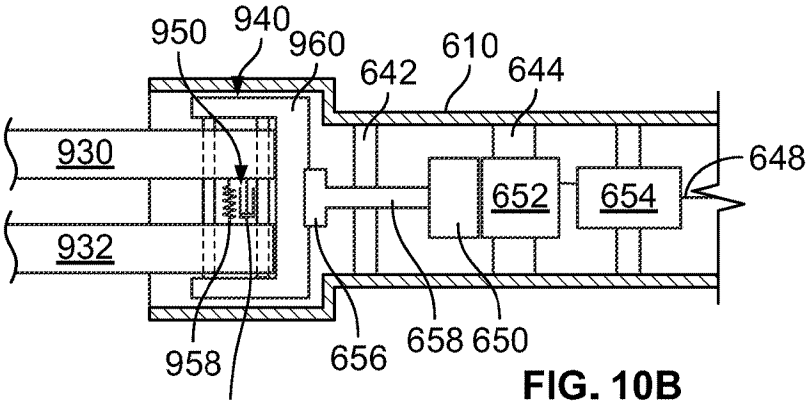
FIG. 10B is a schematic diagram showing an example of certain interior components of an automatic curling iron for adjusting a spacing between rotating prongs.

The automatic curling iron 200 may further include a thermally insulated housing 208 comprising a handle portion 210, holding a rotation mechanism with the two prongs 230, 232 extending away from the handle portion 210 and having a common base concealed by the housing 208 (a base is shown in FIGS. 7B, 8B and 10B). It may further include an electrical circuit for powering the rotation mechanism and for heating the at least one of the prongs, housed in the housing. The rotation mechanism and circuit are further described herein below.

The automatic curling iron 200 may further include a stationary outer styling shell 202, 204 coupled to the housing and enclosing at least a portion of the prongs. The outer styling shell may include at least two longitudinal sections 202, 204 of a cylinder separated so as to expose a length of the gap 220 from an open end of the prongs to near the base. In some embodiments, the outer styling shell is thermally conductive and coupled to a heater of the electrical circuit. In other embodiments, the outer styling shell has a thermal conductivity less than about 10 W/m K. In these and other embodiments, an exterior of the outer styling shell may include a least one of ridges or teeth for engaging hair to be styled. A user may separate the sections 202, 204 of the styling shell by depressing the lever 206, causing both sections 202, 204 to pivot open as shown in FIG. 3.

Figure 12A:
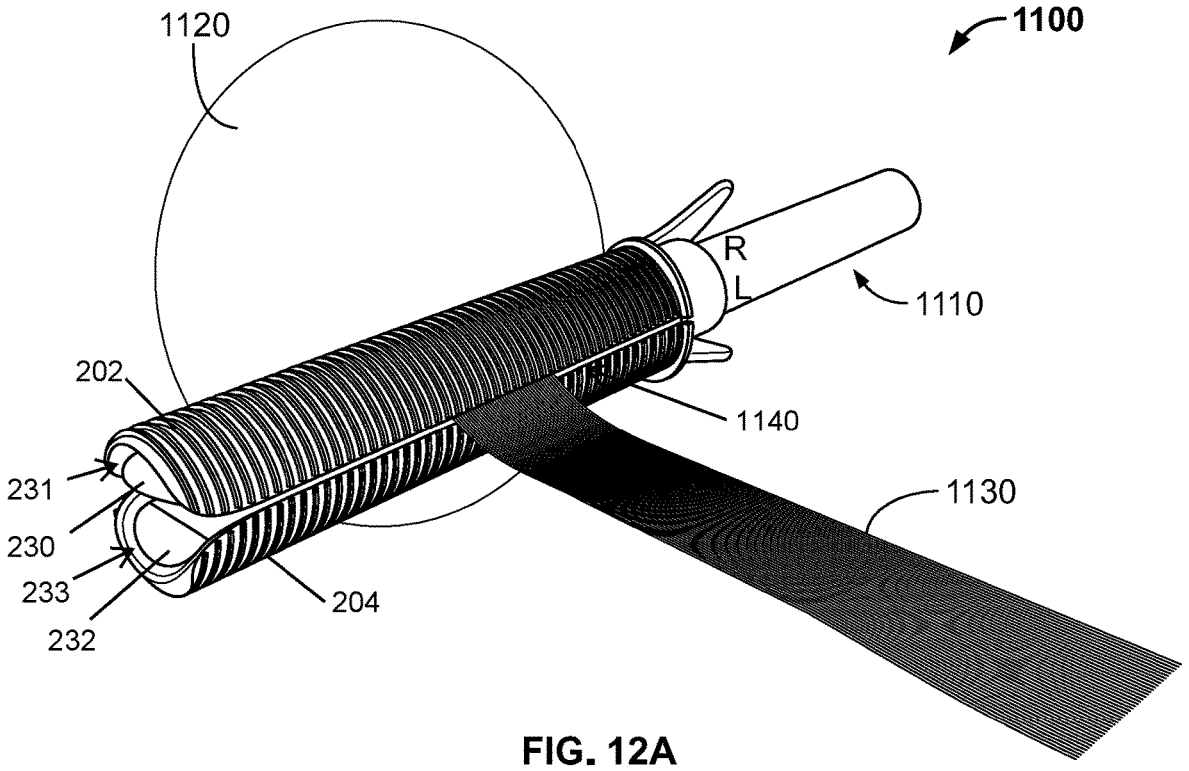
FIGS. 12A-D are perspective views illustrating handling and operation of an automatic curling iron for curling hair.

The handle 210 may include user interface devices for user input to the automatic curling iron's 200 electrical circuit. For example, an on-off switch 224 may be provided on an exterior of the handle 210 and connected to the control circuit, for powering the control circuit on or off. For further example, a forward-reverse switch 222 may be provided on an exterior of the handle 210 and connected to the control circuit, for changing the direction of rotation of the prongs. Other interface devices (not shown) may include a rotation speed control and a temperature-setting device. Power may be supplied to the automatic curling iron 200 via a power cord 226 for connecting to a wall socket. The electrical circuit may be configured to return the rotation mechanism to a "home" state when the iron is powered off. In the "home" state, the gap between the prongs is aligned with a longitudinal opening between the at least two separated sections of the outer styling shell, as shown in FIG. 12A.

Figure 5:
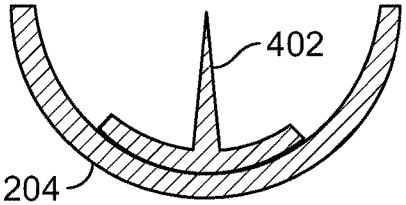
FIG. 5 is a cross-sectional view illustrating placement of an elastomeric fin inside a section of the styling shell.
Figure 4:
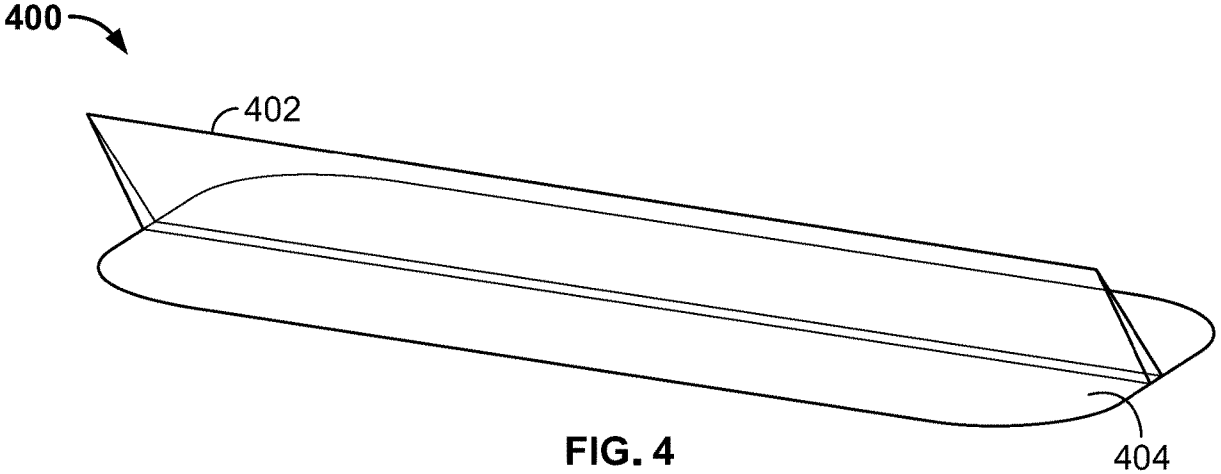
FIG. 4 is a perspective view illustrating a single-bladed elastomeric fin for holding hair against a rotating prong or prongs.

As hair wraps around the heated prongs 230, 232, a resilient interior member may be placed to smooth the bundle of hair being styled and help the hair lie flat and under tension against the prongs. FIG. 4 shows a single-bladed elastomeric fin assembly 400 that may be useful for holding hair against a rotating prong or prongs. The fin assembly 400 includes an elastomeric fin 402 and a base 404. FIG. 5 shows an example of placement of the assembly 400 in a styling shell section 204, via a Section A-A. The base 404 may be adhered to an interior surface of the shell section 204 with the fin 402 directed towards an interior of the shell. While FIG. 5 shows the fin 402 centered in the shell 204 and perpendicular to a tangent to the curvature of the shell at the midpoint, other positions and orientations of the fin may also be suitable. The fin 402 should be oriented to direct a hair bundle inserted through the gap 220 against the prongs 230, 232 as the prongs rotate around the axis 245 relative to the stationary handle 210. A fin assembly 500 may include multiple elastomeric fins 502, 506 for holding hair against a rotating prong or prongs and may be likewise installed.

Irons with more than two prongs may also be useful. FIG. 7A shows an exterior of a three-pronged automatic curling iron 600; the styling shell is omitted for illustrative simplicity. The three-pronged iron 600 includes three parallel prongs 630, 632 and 634 joined at a base, forming a trident 640 as shown in FIG. 7B. The base of the trident 640 may be coupled to a rotation mechanism via a coupling 656. The rotation mechanism may include a drive shaft 658, a gearbox 650, and an electric motor 652 (for example, a stepper motor or brushless DC motor) mounted to an interior of the handle 610 by mounts 642 and 644. The motor 652 may be connected to a circuit 654 receiving power from a power line 648. Other rotation mechanisms may also be suitable, if powered by an electric motor.

Heating mechanisms may be as known in the art, comprising a resistance element thermally coupled to a heated component and regulated by a thermal controller, e.g., a programmable controller or thermostat. A programmable controller may use a proportional-integral-derivative control algorithm in response to one or more temperature sensors and an temperature setting. Details of heating and temperature control circuits are well understood in the art and need not be described here. Power may be supplied to rotating components via a slip ring, inductive power transfer, conductive brushes, or liquid power couplings. In some embodiments, the heated prong is stationary, so no rotating power coupling is needed.

Prongs may be of unequal sizes. FIG. 8A shows an exterior of a two-pronged automatic curling iron with unequal-sized prongs; the styling shell is omitted for illustrative simplicity. A greater-diameter prong 730 lies parallel to a lesser diameter prong 732, which may be joined at a base under the housing 708 and rotate together using a rotation mechanism as shown in FIG. 7B. In some embodiments, the greater-diameter prong 730 may be held stationary by the lesser-diameter prong 732 rotates around it, wrapping the hair around the prong 730. The stationary prong 730 may be the only prong heated, avoiding the need for a rotating power coupling.

FIG. 8B shows an example of a rotation mechanism 740 and other interior components of an automatic curling iron for rotating one prong 732 around a stationary prong 730. In this embodiment, the prong assembly 730 comprises separate pieces, the stationary prong 730 mounted to the handle 720 by a mounting component 642. The rotating prong 732 is attached to a ring 754 mounted to a ring bearing or the like, wherein the stationary prong passes through central openings of the ring 754 and bearing. A ring gear 752 may be formed in or attached to an interior of the base ring 754. A pinion gear 750 may drive the ring gear 752 and may be driven by a shaft 756 attached to a motor 652. The remaining elements may be as previously described in connection with FIG. 7B. Other designs of rotation mechanisms may also be suitable.

Figure 9:
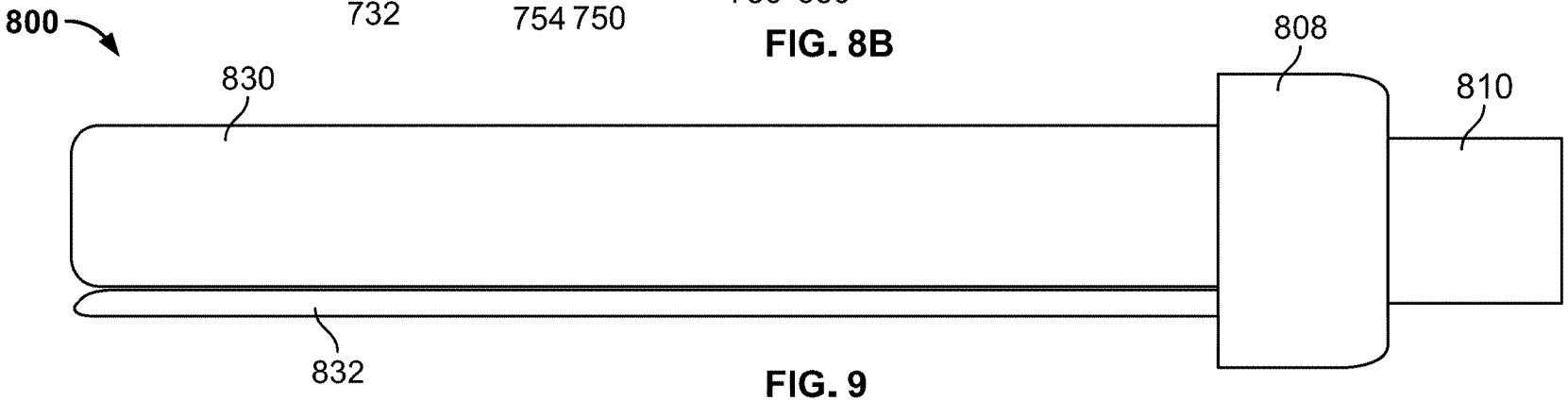
FIG. 9 is a side view illustrating an exterior of a two-pronged automatic curling iron with unequal-sized prongs, showing an alternative spacing of the prongs.

FIG. 9 two-pronged automatic curling iron 800 with unequal-sized prongs 830, 832, showing an alternative spacing of the prongs relative to the iron 700. The housing 808, handle 810 and interior components may be as described for the iron 700.

Automatic curling irons may include a mechanism 940 to allow a user to adjust the spacing of the prongs. FIG. 10A shows an exterior of a two-pronged automatic curling iron 900 with a mechanism under the housing 908 and handle 910 for adjusting a distance between the prongs; the styling shell is omitted for illustrative simplicity. FIG. 10B shows certain interior components of an automatic curling iron 900 for allowing rotation of forked rotating prongs 930, 932 while allowing a user to adjust a spacing between the rotating prongs 930, 932. The prongs 930, 932 may be slideably coupled to a cup-shaped base 960 using a pair of rods. In an alternative, one of the rods may be replaced by a twin-threaded rod, with clockwise threads over half its length and counter-clockwise threads over its remainder. The threaded rod may engage threads in the prongs 930, 932; thus, rotating the threaded rod will drive the pieces 930, 932 together or apart. In another alternative, no threaded rod is used and a driver 950 includes an energy storage component 958 (e.g., a tension spring or compression spring) and a driver 956 (e.g., a pneumatic or hydraulic piston, a linear motor, or a drive screw) that when energized, drives the prongs 930, 932 in opposition to the energy storage component 958. The user can adjust the spacing by setting the driver 956 pressure, causing the prongs to reach equilibrium when the gap therebetween is the desired width. The remaining interior components may be as described in connection with FIG. 7B.

Figure 11:
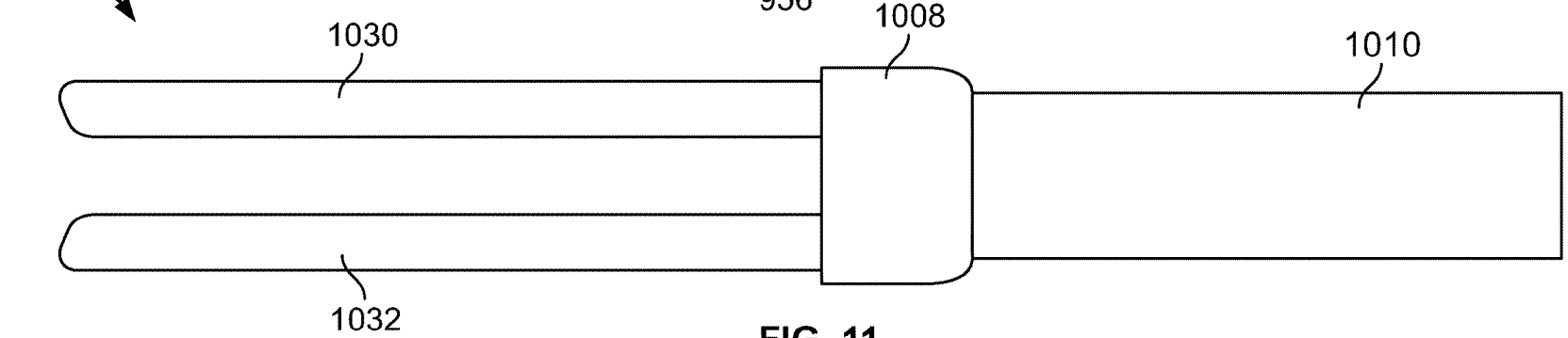
FIG. 11 is a side view illustrating an exterior of a two-pronged automatic curling iron with adjustable spacing, showing the prongs spaced further apart than in FIG. 10A.

FIG. 11 shows an exterior of a two-pronged automatic curling iron 1000 with adjustable or fixed spacing, showing the prongs 1030, 1032 spaced further apart than the prongs 930, 932 in FIG. 10A. The housing 1008 and handle 1010 may hold in their interiors components as described in connection with FIG. 10B. In an alternative, the prongs 1030, 1032 may be fixed and rotated using a mechanism as described in connection with FIG. 7B or 8B.

Figure 12B:
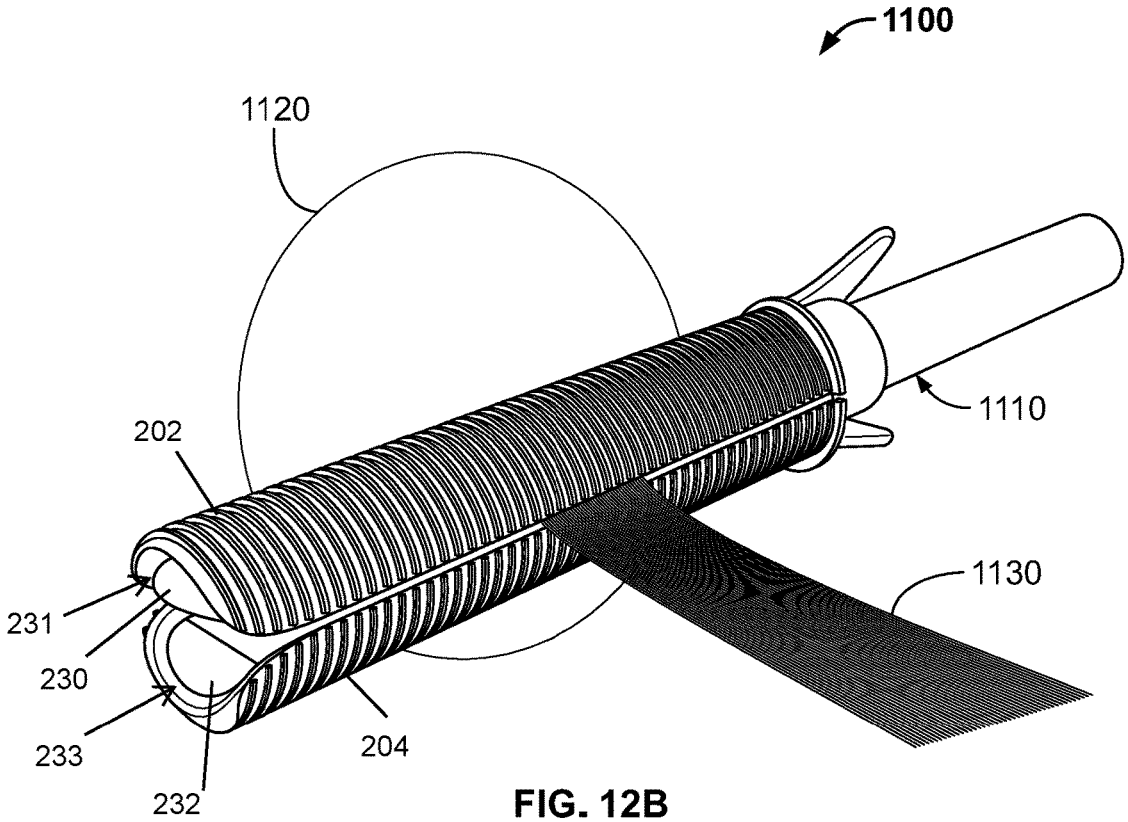
Figure 12C:
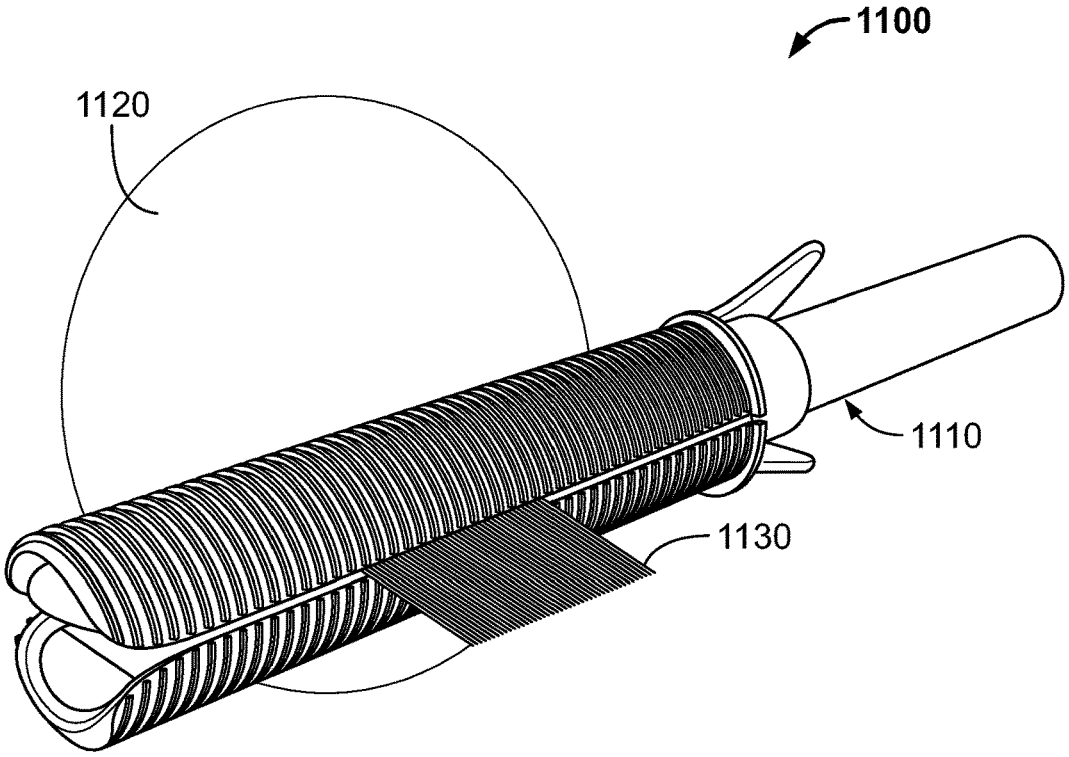
Figure 12D:
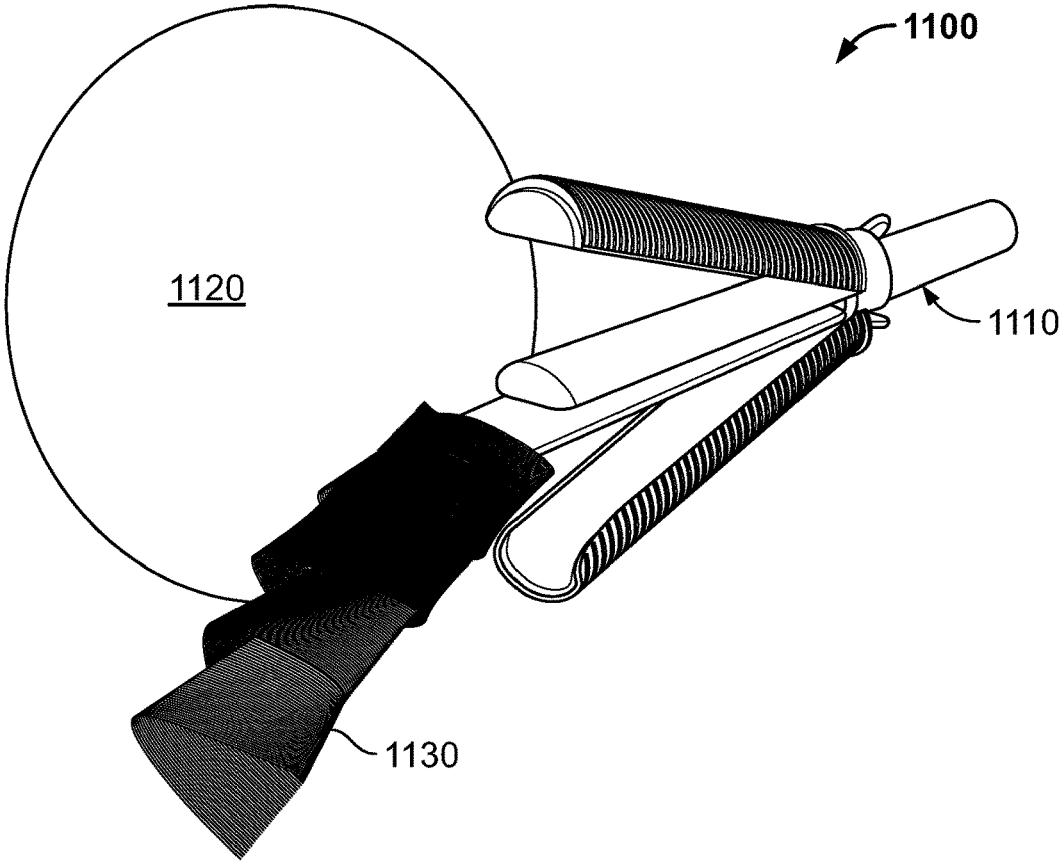

FIGS. 12A-D illustrate handling and operation of an automatic curling iron 1100 for curling hair. A user holds the iron 1100 by the handle 1110 and slides a bundle of hair 1130 taken from the head 1120 into the gap 1140 and moves the bundle 1130 to the base of the prongs 230, 232 (near handle 1110), as shown in FIG. 12A. The user activates the right-left switch to turn on the rotation mechanism. In FIG. 12B the user or an automatic guide mechanism (not shown) guides the hair towards the open end of the iron 1100 as the prongs continue to rotate, causing a helical wrap of the hair bundle around the prongs 230, 232 in the spaces 231, 233 between the shells 202, 204 and the prongs 230, 232. As noted above, an elastomeric fin 402 may fixed to an interior of a shell 202 or 204 and oriented to direct a hair bundle inserted through the gap 1140 against the prongs 230, 232 as the prongs rotate. As shown in FIG. 12C, the guiding and rotating processes continue contemporaneously until the end of the hair bundle 1130 is about to enter the styling shell. In FIG. 12D, the user opens the styling shell and pulls the iron 1100 away from the head 1120, releasing the styled hair. The helical wrap has maintained the desired curl from base to tip of the hair bundle.

Figure 13:
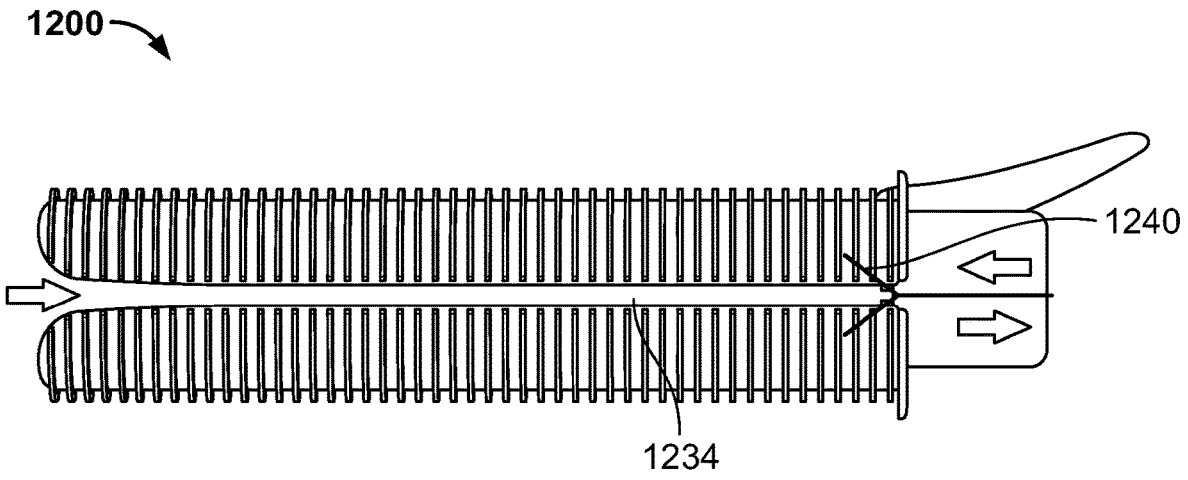
FIG. 13 is a side view of an automatic curling iron with a pushed mechanism for ensuring a helical wrap of hair around the hot prongs of the iron.

FIG. 13 shows an automatic curling iron 1200 with a pusher mechanism 1240 for ensuring a helical wrap of hair around the hot prongs of the iron. The a pusher mechanism and guide 1240 guides strands of hair in the hair bundle along the gap 1234 between a length of the prongs as operation of the rotation mechanism causes hair to wrap around the at least two prongs. The leading end of the pusher/guide 1240 may include a two-pronged fork, vee, or other receiver that gently engages the hair as it is pushed along the length of the gap 1234. The pusher mechanism and guide 1240 helps the hair wrap in a helix along the length of the heated prong(s), so the hair does not wrap over itself and thereby impede heating of the hair to be styled. The handle is not shown for illustrative simplicity. The pusher/guide 1240 may be driven by a threaded rod and electric motor as previously described, or any other suitable linear motion mechanism.

Figure 14:
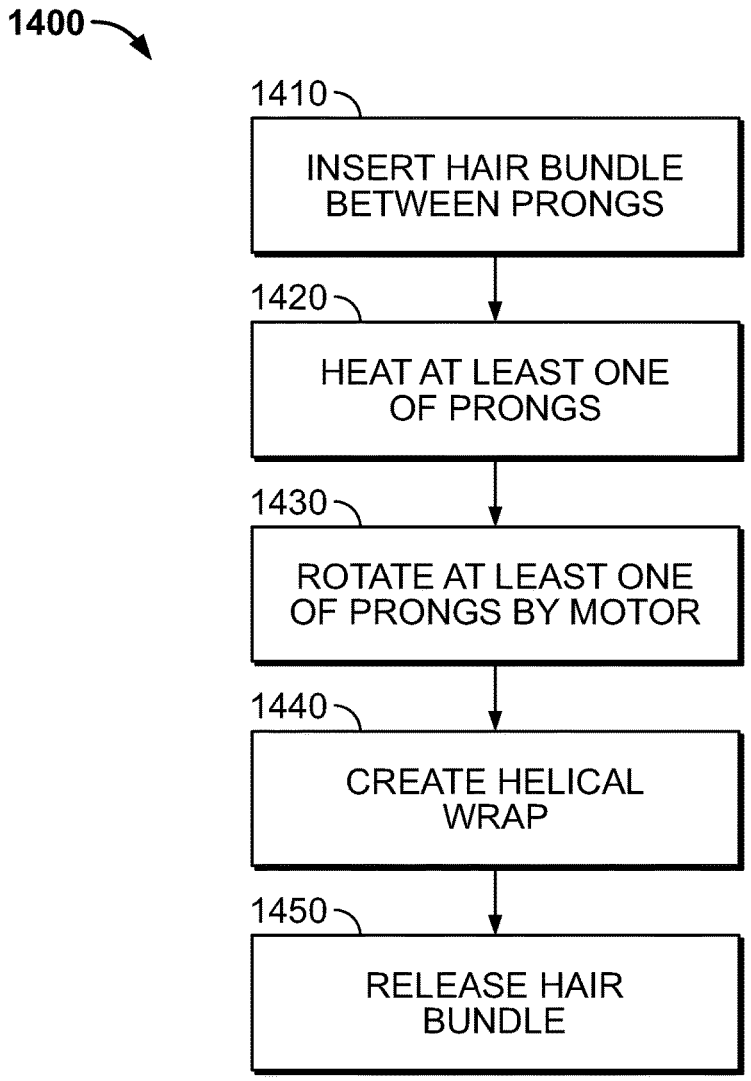
FIG. 14 is a flow chart illustrating a method for curling hair using an automatic curling iron.

As shown in FIG. 14, a method 1400 of using an automatic curling iron to style hair may include, at 1410, inserting a bundle of hair between parallel prongs of an automatic curling iron. The method 1400 may further include, at 1420, heating at least one of the prongs to a desired operating temperature. The method may further include, at 1430, rotating by an electrical motor at least one of the prongs around a common longitudinal axis of the prongs while moving a protruding end of the bundle of hair along the longitudinal axis, causing the bundle of hair to wrap in a helix 1440 around at least one of the prongs. The method may further include, at 1450 releasing the bundle of hair from the prongs once the hair has been heated while in a helical wrap.

The previous description of the disclosed aspects is provided to enable any person skilled in the art to make or use the present disclosure. Various modifications to these aspects will be clear to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. An apparatus for curling hair, comprising:

at least two parallel prongs defining a gap there between and aligned along a longitudinal axis, wherein at least one of the prongs is thermally conductive;

a rotation mechanism coupled to at least one of the prongs at a base of each prong, configured to rotate at least one of the prongs around the longitudinal axis;

a thermally insulated housing comprising a handle portion, holding the rotation mechanism with the two prongs extending away from the handle portion;

a stationary outer styling shell coupled to the housing and substantially enclosing the prongs along their length;

at least one fin of elastomeric high temperature material mounted to an interior of the styling shell extending along a length thereof from the interior towards the prongs and positioned to hold strands of hair against a heated one of the prongs; and an electrical circuit for powering the rotation mechanism and for heating the at least one of the prongs, housed in the housing.

2. The apparatus of claim 1, wherein the outer styling shell comprises at least two longitudinal sections of a cylinder separated so as to expose a length of the gap from an open end of the prongs to near the base.

3. The apparatus of claim 2, wherein the at least two longitudinal sections are coupled to an expansion mechanism that enables a user to expand and contract a perimeter of the outer styling shell.

4. The apparatus of claim 3, wherein the electrical circuit is programmed to return the rotation mechanism to a "home" state in which the gap between the prongs is aligned with a longitudinal opening between the at least two separated sections of the outer styling shell.

5. The apparatus of claim 3, wherein the at least two longitudinal sections are spaced away from the prongs when positioned parallel thereto.

6. The apparatus of claim 1, wherein the at least one fin comprises multiple parallel fins.

7. The apparatus of claim 1, wherein the elastomeric material comprises a silicone rubber material with a hardness in a range of 10 to 90 Shore A.

8. The apparatus of claim 1, wherein the prongs are substantially identical and arranged symmetrically around the longitudinal axis.

9. The apparatus of claim 1, further comprising an adjustment mechanism positioned at an end of the prongs proximal to the base for adjusting separation between the prongs.

10. The apparatus of claim 1, wherein the electrical circuit further comprises a user interface control for adjusting a direction of rotation of the rotation mechanism.

11. The apparatus of claim 1, wherein the outer styling shell is thermally conductive and is coupled to a heater of the electrical circuit.

12. The apparatus of claim 1, wherein the outer styling shell has a thermal conductivity below 10 W/m K.

13. The apparatus of claim 1, wherein an exterior of the outer styling shell includes a least one of ridges or teeth for engaging hair to be styled.

14. The apparatus of claim 1, further comprising a pusher mechanism and guide for guiding strands of hair along a length of the prongs as operation of the rotation mechanism causes hair to wrap around the at least two prongs.

15. The apparatus of claim 14, wherein the at least one of the prongs that is thermally conductive is stationary and connected to the electrical circuit for heating.

16. The apparatus of claim 15, wherein a movable one of the prongs has a smaller average cross-section than the stationary one of the prongs.

17. The apparatus of claim 16, wherein the rotation mechanism is configured for rotating the movable one of the prongs around the stationary one of the prongs.

18. The apparatus of claim 1, wherein the rotation mechanism is configured for rotating both prongs together around the longitudinal axis.

19. A method of using an automatic curling iron to style hair, the method comprising:

inserting a bundle of hair between parallel prongs of an automatic curling iron under a stationary outer styling shell coupled to the housing and enclosing at least a portion of the prongs, wherein at least one fin of elastomeric high temperature material mounted to an interior of the styling shell extending along a length thereof from the interior towards the prongs is positioned to hold strands of hair against a heated one of the prongs;

heating at least one of the prongs to a desired operating temperature;

rotating by an electrical motor at least one of the prongs around a common longitudinal axis of the prongs while moving a protruding end of the bundle of hair along the longitudinal axis, causing the bundle of hair to wrap in a helix around at least one of the prongs under the styling shell; and releasing the bundle of hair once heated.

20. An apparatus for curling hair, comprising:

at least two parallel prongs defining a gap there between and aligned along a longitudinal axis, wherein at least one of the prongs is thermally conductive;

a rotation mechanism coupled to at least one of the prongs at a base of each prong, configured to rotate at least one of the prongs around the longitudinal axis;

a thermally insulated housing comprising a handle portion, holding the rotation mechanism with the two prongs extending away from the handle portion;

an outer styling shell coupled to the housing and substantially enclosing the prongs along their length, wherein the outer styling shell comprises at least two longitudinal sections of a cylinder separated so as to expose a length of the gap from an open end of the prongs to near the base and is pivotable between open and closed positions;

an adjustment mechanism positioned at an end of the prongs proximal to the base for adjusting separation between the prongs; and an electrical circuit for powering the rotation mechanism and for heating the at least one of the prongs, housed in the housing.

* * * * *